United States Patent [19]

Moreau

[11] Patent Number: 5,014,157

[45] Date of Patent: May 7, 1991

[54] APPARATUS FOR CONTROLLING AND TESTING AN ELECTRIC INSTALLATION

[75] Inventor: Dominique Moreau, Saint Germain En Laye, France

[73] Assignee: Telemecanique, France

[21] Appl. No.: 354,669

[22] Filed: May 22, 1989

[30] Foreign Application Priority Data

May 20, 1988 [FR] France ..... 88 06767

[51] Int. Cl.[5] ..... H01H 47/00

[52] U.S. Cl. ..... 361/187; 361/189; 361/396

[58] Field of Search ..... 361/187, 391, 393, 394, 361/396; 335/132

[56] References Cited

U.S. PATENT DOCUMENTS

| | | | |
|---|---|---|---|
| 3,588,616 | 6/1971 | Palazzinni | 361/393 |
| 3,727,157 | 4/1973 | Grunert et al. | 335/132 |
| 3,980,978 | 9/1976 | Lacan | 335/132 |
| 4,137,559 | 1/1979 | Reuting | 335/132 |
| 4,356,368 | 10/1982 | Osika | 335/132 |
| 4,616,177 | 10/1986 | McClain et al. | 361/394 |
| 4,622,444 | 11/1986 | Kandatso et al. | 335/132 |
| 4,879,437 | 11/1989 | Dard et al. | 335/132 |
| 4,922,407 | 5/1990 | Birk et al. | 361/394 |
| 4,926,149 | 5/1990 | Saens et al. | 335/132 |

FOREIGN PATENT DOCUMENTS

| | | | |
|---|---|---|---|
| 1188372 | 4/1970 | United Kingdom | 361/394 |

OTHER PUBLICATIONS

"Molded Stackable Surface Mounted Connectors", disclosed anonymously, Reproduced from RESEARCH DISCLOSURE, Sep. 1986, No. 269, Kenneth Mason Publication Ltd., England.

*Primary Examiner*—A. D. Pellinen
*Assistant Examiner*—Jeffrey A. Gaffin
*Attorney, Agent, or Firm*—William A. Drucker

[57] ABSTRACT

An apparatus for controlling an electric installation is obtained by assembling a removable modular control device on a contactor. The lower face of this control device is provided with two rigid projecting pins located so as to be engaged and clamped in two respective control terminals of the contactor. These projecting pins are connected to two respective input terminals provided on the upper face of the control device, by an electric circuit having an elementary function.

9 Claims, 3 Drawing Sheets

APPARATUS FOR CONTROLLING AND TESTING AN ELECTRIC INSTALLATION

BACKGROUND OF THE INVENTION

The invention relates to a control and testing system for an installation using a multiplicity of contactor apparatus each comprising power switches which are actuated by an electromagnet having an energization coil whose accessible terminals are connected electrically to a supply and processing circuit capable of amplifying, respectively delivering or interrupting, automatically or manually, current signals having appearance or disappearance delays with respect to reference signals or not.

Known control systems of the prior art generally comprise a cabinet or board in which are disposed circuits for processing different information which may comprise programmable automatic devices, timers, function selectors, signalling lamps, as well as manual control means, independent of the automatic device, for carrying out adjustments for example.

In one embodiment, also widely used, some of these means are disposed in reduced number, not on the panel of a cabinet, but on the front face of the cover of a small box containing the said contactor(s) to which they are connected by conductors going either from the cover to the terminals of the contactor coils or extending directly between some of these means and the said terminals when these members are all fixed to the base of the box.

A determined number of simple functions whose execution is left usually to an automatic device assembly, when the final structure of the latter has been worked out beforehand, may nevertheless subsequently become necessary. This case occurs in installations where progressive evolution implies a corresponding increase in the number of functions related for example to new regulations, such as those concerning safety, or those which are imposed when new manufacturing units are added to the original units.

In this latter case, the size of a cabinet or respectively a box may be insufficient.

SUMMARY OF THE INVENTION

The invention consequently provides the user of a conventional automatic system with simple and compact means for responding to an extension of the original functions or to special needs which would justify neither the partial reconstruction of an existing system nor the use of a more sophisticated automatic device; this invention will nevertheless be able to respond also to the needs of the users of simple systems, considering the choice which is offered them of obtaining, in an extended range of products of the same size, the elementary functions which they may require.

Finally, the invention is based on the discovery that it is frequently easier to locate and so repair or bring into operation a simple automatic device when the latter is placed in relation with the contactor(s) which are the most directly associated therewith.

According to the invention, the aim sought is attained because this system uses a multiplicity of modules each having an insulating case which can be asociated electrically and mechanically with the accessible terminals of the coil of an associated contactor through two projecting conducting pins, the internal volume of these cases being occupied by one of a multiplicity of elementary circuits capable of effecting, and in a non limitative way:

a. series electronic timing which is tripped on the appearance of a signal,
b. series electronic timing which is tripped on the disappearance of a signal,
c. galvanic insulation between the potentials of the signals and the potential of the coil supply source,
d. selection between orders elaborated by a programmable automatic device and starting or stopping orders resulting from local manual intervention,
e. electronic amplification of low signals, these cases further having substantially equal widths closely related to the width of the contactors with which they are associated and further having input terminals, respectively status control or display members, placed on adjacent front faces of the front faces of the corresponding contactors.

BRIEF DESCRIPTION OF THE DRAWINGS

The invention will be better understood from the following description with reference to the accompanying figures which illustrate.

DESCRIPTION OF THE PREFERRED EMBODIMENTS

Figure 1:
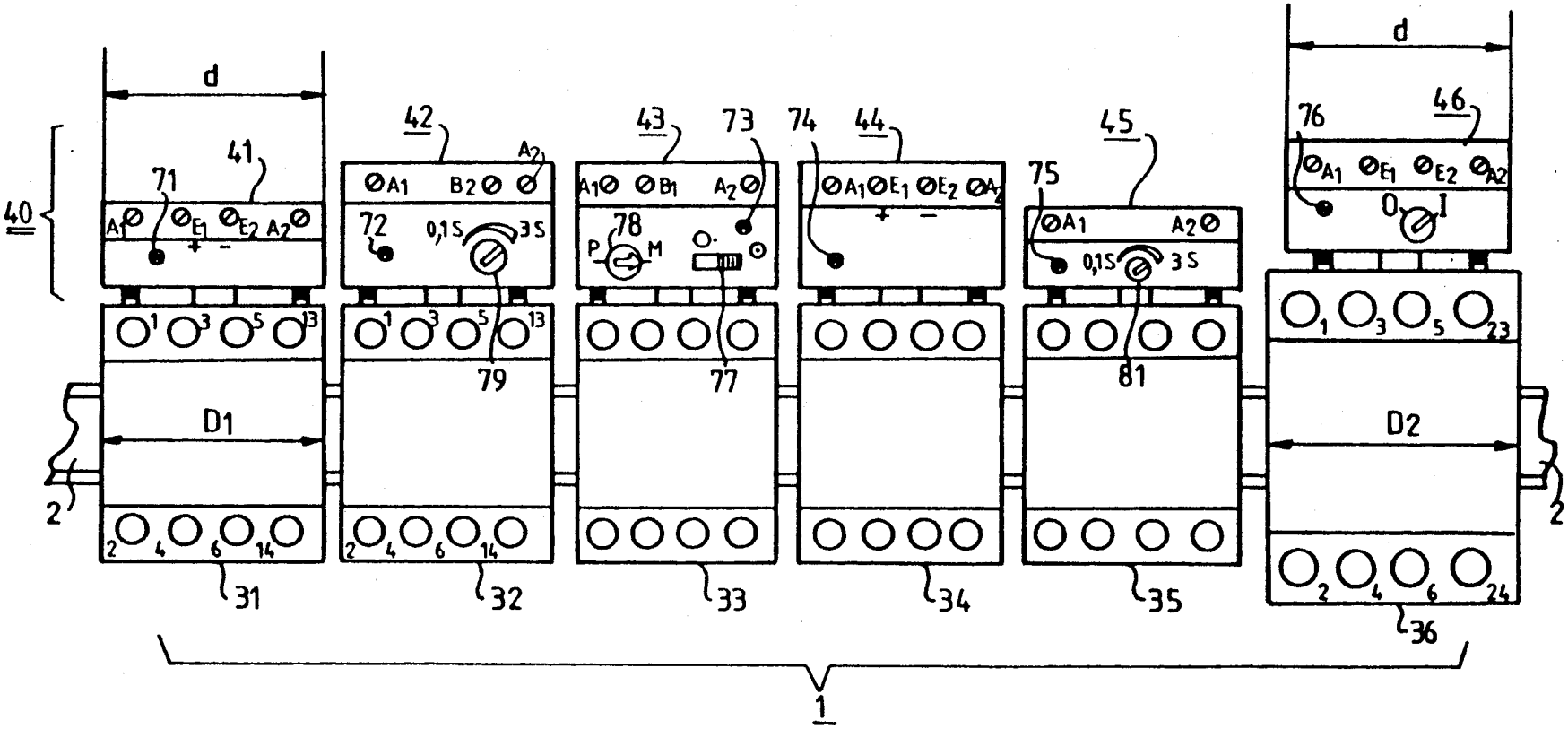
FIG. 1, a front view of a multiplicity of contactors mounted side by side on a wall and equipped with modules in accordance with the invention, FIG. 2, a front view of a contactor coil, opposite the terminals of which is situated a special module, FIG. 3, a side view of FIG. 2 in which the module is effectively associated with the terminals of the coil, FIG. 4, a schematic view of the electromechanical or electronic circuits which may be incorporated in appropriate module cases, and FIG. 5, a schematic side view illustrating one method of mounting a module of the invention on a contactor.

A plurality of contactor apparatus 31, 32, 33, 34, 35, 36 belonging to a simple automatic device or to a portion of a more extensive automatic system, is shown in FIG. 1, where it will be noticed that these contactors are attached side by side on the same standardized rail 2 fixed to a wall.

Figure 2:
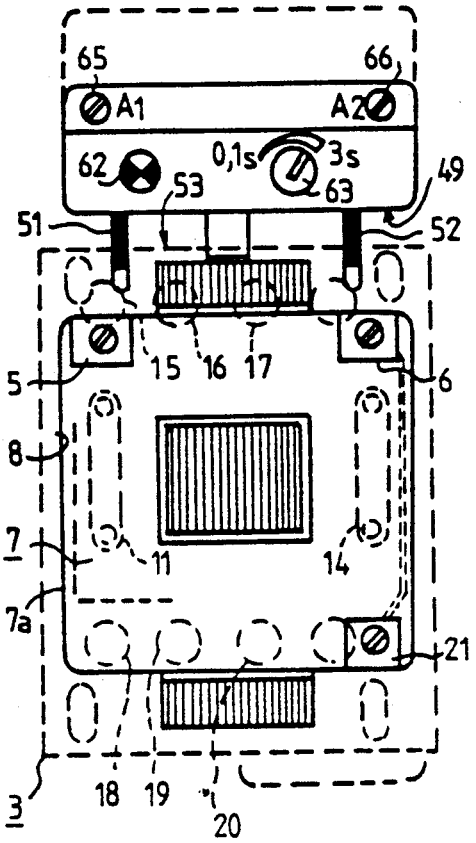
Figure 3:
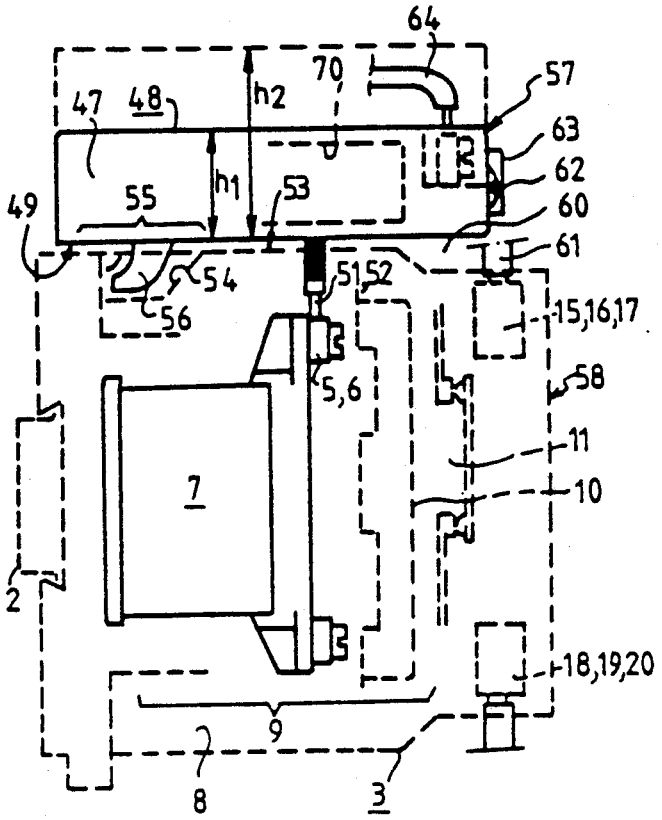

As can be seen more precisely in FIGS. 2 and 3, each of these contactors, such as 3, comprises terminals 5, 6 which are connected to a coil 7 or are carried by the carcase 7*a* thereof, which is disposed in a case 8 for energizing an electromagnet 9, a mobile armature 10 of which actuates power switches such as 11 and, possibly, a signalling or latching switch 14 when the yoke 13 is magnetized.

These switches are connected to input and output power terminals such as 15, 16, 17, respectively 18, 19, 20. It will be noted in FIG. 1 that the numbers placed adjacent these terminals, and which are not accompanied by a reference line, must not be confused with the references of the same rank. These numbers correspond to the reference which are standardized for facilitating recognition of the functions provided by these switches.

In a way known per se, a third terminal 21 electrically connected to terminal 6 is placed opposite the latter and on the carcase so as to comply with certain wiring requirements.

With each of the contactors 31 . . . 36 are associated intermediate modules such as 41 . . . 46 which belong to a multiplicity 40 of modules, each of which provides a particular function which is directly related to the operation of the coil.

For this, each case 47 of a module such as 48, see FIGS. 2 and 3, has on a lower face 49 two projecting partially insulated output terminals 51, 52 which are adapted to cooperate with upper terminals adjacent the coil, such as 5, 6, opening on to the upper face 53 of the contactor. This same face has a recess with shoulder 54 which is placed in a region 55 distant from terminals 5, 6 and which is adapted to receive a hook 56 integral with face 49; the mechanical fixing and electric connection, which might be provided solely by nipping the ends of the pins in the corresponding terminals, is here advantageously completed by the presence of these hooking means 56, 54.

As can be seen in FIG. 3, each module case 47 has a front face 57 which is placed in the vicinity of the front face 58 of the contactor and parallel thereto, without encroaching on a volume 60 devoted to the passage of conductors which, such as 61, lead to the upper input power terminals 15, 16, 17.

The front face 57 of the module 48 which has for example an indicator light 62 and an adjustment knob 63 also has the inlets required for a screwdriver for tightening the conductors, such as 64, connected to the input terminals of the module, such as 65, 66; these inlets themselves opening on to an upper face of the module.

In the example chosen, these terminals are only two in number, but their number may be greater, as can be seen in particular in FIG. 1.

Each module case 47, such as those shown at 41, 46 in FIG. 1, preferably has a width -d- which is close to the width -$D_1$- respectively -$D_2$- , of the contactor 31 . . . 36 with which it is associated; these widths are measured parallel to the rows of power terminals.

When the contactor case, such as 36, is wider than a contactor such as 31 . . . 35, the same modules may be associated therewith, either because of the existence of coil terminals having spacings corresponding to those of the pins, or because of the fact that even if these coil terminals are spaced wider apart, the pins of the modules may penetrate therein in adequate regions by passing from one side or the other of the corresponding clamping screws.

It will be further noted, in FIGS. 1 to 3, that the heights of the module cases may range between two values shown by -$h_1$- and -$h_2$- depending on the volume 70 which is required for disposing the internal components chosen for providing a particular function.

Figure 4:
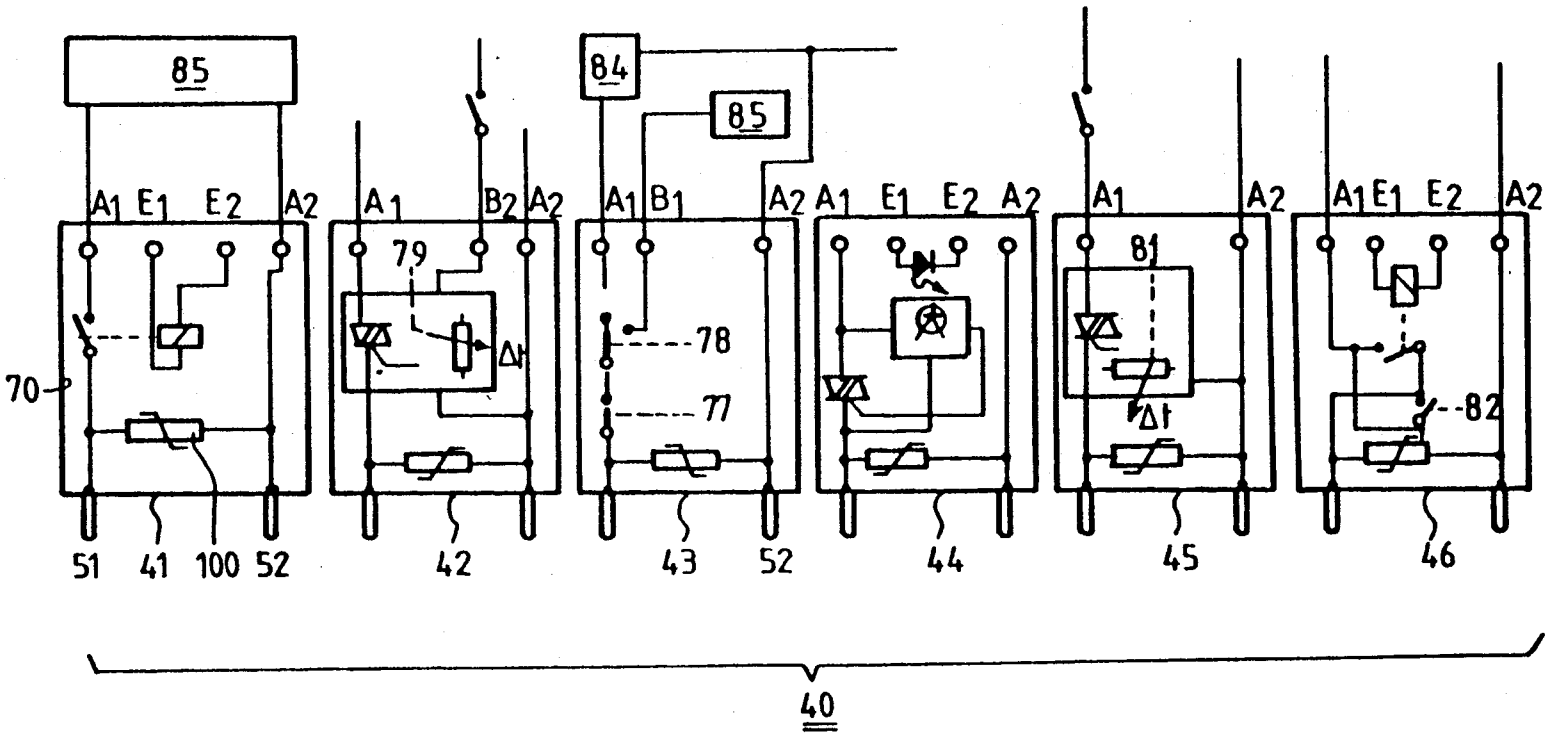

Among the functions which may be provided by these modules, there may be for example, and non limitatively:

a module 41 serving as relay amplifier, a module 42 providing in series electronic rest timing which introduces an adjustable delay on de-energization with respect to the disppearance of a reference signal through the adjustment member 79, a module 43 whose function is to provide either a voluntary interruption of the power supply to the coil through the manual control member 77, or a choice of the origin of the supply signals coming from a controller 84 or from an independent source 85, through the presence of an orientation switch whose manual control member is shown at 78, see also FIG. 4, a module 44 serving as electronic amplifier for low level signals, a module 45 providing, electronically and in series, working timing which introduces an adjustable delay between the moment when a signal appears and the moment when the current flows through the coil, by means of the adjustment knob 81, a module 46 whose function makes it possible to provide in parallel a voluntary power supply for the coil, through the manual member 82, whereas this coil is normally fed through a small relay so as to provide galvanic insulation between the control signals and the supply source for the coil.

It will be advantageous to dispose an indicator light on the front face of each of the modules, using for example a LED such as those shown at 71 . . . 76, so as to signal the presence of voltage at the terminals of the coil or, respectively, the flow of a current therethrough.

The electromechanical and electronic circuits and means for carrying out the above mentioned functions may have different constructions, so that only equivalent diagrams have been illustrated in FIG. 4 . It will be noted that a component 100 for protecting against overvoltages, using for example a zine oxide, is systematically connected between the terminals 51,52. Generally, the input terminals such as $A_2$ are connected directly to one of the output temrinals 52.

Finally, these output terminals 51, 52 have a sufficient length -q- , and the terminals 5, 6 of the coil have a penetration possibility such that each of these modules 90 may be mounted and associated with a contactor 91 despite the presence between it and this contactor of an auxiliary case 92 serving for protecting the coil against parasites, using an RC circuit.

Figure 5:
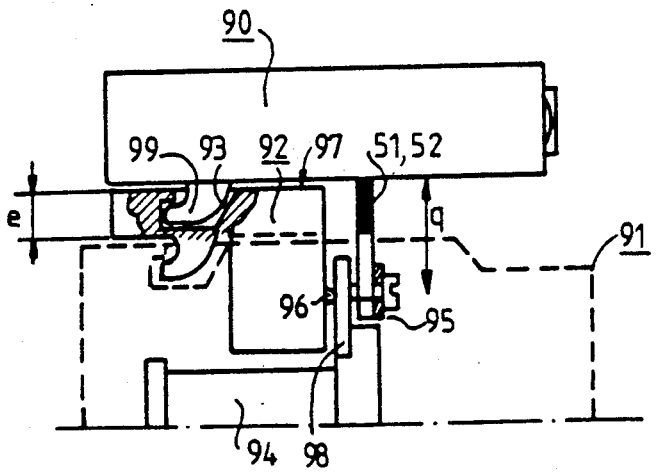

This auxiliary case has, for this purpose, a very small thickness -e- , see FIG. 5. So that the fastening of the module has in this case the same qualities, a recess and a shoulder 93 may advantageously be provided on an upper face 97 of this auxiliary protection device, comparable to those which are provided on the upper face of the contactor for cooperating with hook 99.

This auxiliary case will advantageously be connected to the terminals of coil 94, such as 95, by means of the resilient bearing forces of conducting pieces 96 of the auxiliary case coming into contact with terminal regions not occupied by the clamping screws, such as region 98.

What is claimed is:

1. An apparatus for controlling an electric installation, said device being constituted by assembling of a removable modular control device on a contactor means comprising a housing having a upper wall and a front wall, and, lodged in the said housing, power switching means actuated by an electromagnet having a coil, the two ends of which are respectively connected to two respective control terminals adapted to receive external electric conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal by means of a series electronic timing circuit which is tripped on the appearance of a control signal applied on said second input terminal, said first and second input terminals each having an input orifice formed in the upper face of the case and a clamping screw accessible through an opening formed in the front face of the case.

2. An apparatus for controlling an electric installation, said device being constituted by assembling of a removable modular control device on a contactor means comprising a housing having a upper wall and a front wall, and, lodged in the said housing, power switching means actuated by an electromagnet having a coil, the two ends of which are respectively connected to two respective control terminals adapted to receive external electric conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal by means of a series electronic timing circuit which is tripped on the disappearance of a control signal applied on said second input terminal, said first and second input terminals each having an input orifice formed in the upper face of the case and a clamping screw accessible through an opening formed in the front face of the case.

3. An apparatus for controlling an electric installation, said device being constituted by assembling of a removable modular control device on a contactor means comprising a housing having a upper wall and a front wall, and, lodged in the said housing, power switching means actuated by an electromagnet having a coil, the two ends of which are respectively connected to two respective control terminals adapted to receive external electric conductors passing through a first pair of openings formed in the upper wall and to clamp said conductors by means of clamping means accesible through a second pair of openings formed in the front wall, said romovable modular control device comprising an insulating case having an upper face, a front face and a lower face which is provided with first and second rigid projecting pins located so as to be engaged and clamped in the control terminals of the contactor, thus providing electrical and mechanical connection thereto, the first projecting pin being connected to a first input terminal, and the said second projecting pin being connected to at least a second input terminal by means of a switching circuit comprising at least a switch actuated by a manual control element provided on said front face, said switching circuit effecting a selection between signal orders applied on said second input terminal and forced starting or stopping orders resulting from a local manual intervention on said manual control element, said first and second terminals each having an input orifice formed in the upper face of the case and a clamping screw accessible through an opening formed in the front face of the case.

4. An apparatus for controlling an electric installation, said device being constituted by assembling of a removable modular control device on a contactor means comprising a housing having a upper wall and a front wall, and, lodged in the said housing, power switching means actuated by an electromagnet having a coil, the two ends of which are respectively connected to two respective control terminals adapted to receive external electirc conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal by means of means for amplifying control signals applied on said second input terminal, said first and second terminals each having an input orifice formed in the upper face of the case and a clamping screw accessible through an opening formed in the front face of the case.

5. An apparatus for controlling an electric installation, said device being constituted by assembling of removable modular control device on a contactor means comprising a housing having a upper wall and a front wall, and, lodged in the said housing, power switching means actuated by an electromagnet having coil, the two ends of which are respectively connected to two respective control terminals adapted to receive external electric conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal, by means of an electric circuit comprising manual control means disposed on said front face, said first and second terminals each having an input orifice formed in the upper face of the case and a clamping screw accessible through an opening formed in the front face of the case.

6. The apparatus as claimed in claim 5, which further comprises means for signalling the electric state of the projecting pine, these signalling means being provided on the said front face.

7. An apparatus for controlling an electric installation, said device being constituted by assembling of a removable modular control device on a contactor means comprising a housing having a upper wall and a front wall, and, lodged in the said housing, power switching means actuated by an electromagnet having a coil, the two ends of which are respectively connected to two respective control terminals adapted to receive external electric conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal, wherein said lower end further copmprises first hooking means which cooperates with second hooking means provided on the upper wall of the contactor, said first hooking means being distant from said projecting pins, said first and second terminals each having an input orifice formed in the upper face of the case and a clamping screw accessible through an opening formed in the front face of the case.

8. An apparatus for controlling an electric installation, said device being constituted by assembling of a removable modular control device on a contactor means comprising a housing having a upper wall and a front wall, and, lodged in the said housing, power switching means actuated by an electromagnet having coil, the two ends of which are respectively connected to two respective control terminals adapted to receive external electric conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal, wherein the said front face is offset rearwards with respect to the front wall of the contactor so as to allow passage of conductors connected to power terminals provided on the upper wall of the contactors, said first and second terminals each having an input orifice formed in the upper face of the case and a clamping screw accessible through an opening formed in the front face of the case.

9. An apparatus for controlling an electric installation, said device being constituted by assembling of a removable modular control device on a contactor means comprising a housing having a upper wall and a front wall, and, lodged in the said housing, power switching means actuated by an electomagnet having a coil, the two ends of which are respectively connected to two respective control terminals adapted to receive external electric conductors passing through a first pair of openings formed in the upper wall and to clamp said conductors by means of clamping means accessible through a second pair of openings formed in the front wall, said removable modular control device comprising an insulating case having an upper face, a front face and a lower face which is provided with first and second rigid projecting pins located so as to be engaged and clamped in the control terminals of the contactor, thus providing both electrical and mechanical connection thereto, the first projecting pin being connected to a first input terminal, and the said second projecting pin being connected to at least a second input terminal, wherein the said projecting pins having sufficient lengths -q- so that they may be held in the terminals of the coil of the contactor by leaving between the latter and the module a gap adapted to receive a protection case of small thickness -e- cooperating electrically with the terminals of this coil

* * * * *